United States Patent [19]

Cunningham

[11] 4,323,127

[45] Apr. 6, 1982

[54] ELECTRICALLY OPERATED IMPACT TOOL

[76] Inventor: James D. Cunningham, 2100 Topaz, Boulder, Colo. 80302

[21] Appl. No.: 19,073

[22] Filed: Mar. 9, 1979

Related U.S. Application Data

[63] Continuation-in-part of Ser. No. 799,092, May 20, 1977, abandoned.

[51] Int. Cl.[3] ..... B25C 1/06

[52] U.S. Cl. ..... 173/53; 173/121; 173/124; 173/1; 124/78; 227/8; 227/131

[58] Field of Search ..... 29/432, 526 R; 124/1, 124/10, 78; 173/1, 13, 53, 117, 121, 122, 124, 156; 226/154, 181, 182, 183, 186, 187; 227/5, 6, 8, 129, 130, 131, 132, 133, 134, 147

[56] References Cited

U.S. PATENT DOCUMENTS

| | | | |
|---|---|---|---|
| 997,638 | 7/1911 | Ryncarson | 173/53 X |
| 1,483,071 | 2/1924 | Calder | 173/121 X |
| 1,647,493 | 11/1927 | Young | 173/122 X |
| 1,951,170 | 3/1934 | Schwob | 173/124 X |
| 2,487,530 | 11/1949 | Dirksen | 173/53 |
| 2,584,979 | 2/1952 | Bassinger | 173/121 |
| 2,869,824 | 1/1959 | Hazak | 173/53 |
| 3,141,171 | 7/1964 | Doyle et al. | 227/8 UX |
| 3,157,235 | 11/1964 | Raizk et al. | 173/53 |
| 3,482,754 | 12/1969 | Doherty | 227/131 |
| 3,554,424 | 1/1971 | Newton et al. | 227/8 |
| 3,809,307 | 5/1974 | Wandel et al. | 227/8 |
| 3,972,394 | 8/1976 | Jacko et al. | 188/251 A X |
| 4,042,036 | 8/1977 | Smith et al. | 173/13 |

FOREIGN PATENT DOCUMENTS

| | | | |
|---|---|---|---|
| 175347 | 12/1951 | Austria | 226/154 |
| 909123 | 11/1945 | France | 124/78 |
| 227182 | 1/1969 | U.S.S.R. | 173/124 |

*Primary Examiner*—Robert Mackey

*Attorney, Agent, or Firm*—Horace B. Van Valkenburgh; Richard D. Law

[57] ABSTRACT

One or both of a pair of oppositely rotating bodies, such as motor driven flywheels, are mounted for pivotal movement against the side of a ram. One or more tension rods connect pivot shafts or members for equalizing precession and similar forces of rotating bodies, rather than housing. Pulsed solenoids produce force increased by force multiplying device, such as pivoted links or cable arrangement, which has greatest mechanical advantage when solenoid pull is weakest at start, but decreases as solenoid pull increases. Ram has entrance taper on one or both sides. Ram is returned by nylon sheathed bundle of elastomer cords which are looped around ram from both sides and stretch proportionally along their length. Removable guide rods engage holes in side wings of ram. Safety device is actuated by rod, moved through engagement with work piece, for closing safety switch in solenoid circuit. Alternatively, a block engages a ram wing to prevent impact stroke, but is removed by a similar rod. Alternatively, a stop block is placed between motor housings to prevent movement against ram until work piece is engaged and similar rod moves spring pressed pivoted link to withdraw stop block.

27 Claims, 26 Drawing Figures

ELECTRICALLY OPERATED IMPACT TOOL

This application is a continuation-in-part of my prior application Ser. No. 799,092, filed May 20, 1977 (now abandoned).

This invention relates to electrically driven impact tools and a method of operating the same, particularly to such tools which may be adapted to drive nails and the like.

BACKGROUND OF THE INVENTION

Prior electrically driven impact tools have utilized low amounts of energy and have been used in applications, such as for driving small nails and staples, loosening and tightening nuts or seating deformable fasteners, such as small brass and copper rivets. Substantially all high energy impact tools, particularly those which have been sufficiently light to be hand used, have operated on compressed air. However, such air tools have required, for supply of air through hoses to the tools, a high volume air compressor which is stationary or requires a cumbersome trailer or similar support, for transportation and location at the site at which the tool or tools are to be used. The additional pneumatic equipment, such as pressure regulators, lubricators, filters and the like, complicate the supply mechanism. Electrically driven impact tools which are hand held and especially those which are adaptable to nail driving purposes, are quite attractive in view of the fact that, at almost all construction sites, electrical power is normally available in substantially any desired quantity.

It has been proposed, in the James E. Smith and James D. Cunningham U.S. application Ser. No. 580,246, now U.S. Pat. No. 4,042,036, to provide an electrical impact tool having a specific application to a nail driving tool by utilizing one stationarily mounted and one pivotally mounted motor and rotating flywheel assembly, with the stationarily mounted, rotating flywheel being adjacent one side of a ram and the opposite side of the ram being engaged by the pivotally mounted, rotating flywheel. Movement of the latter into engagement with the ram is produced by a movable nose piece which is pushed into engagement with the work. Lateral movement of the latter is used to push the ram against the stationarily mounted, rotating flywheel, which requires that the ram have sufficient lateral play to accommodate this movement, with the result that undue wear on one side of the ram is produced. Often, an inadequate force is produced to move the pivoted, rotating flywheel into engagement with the ram. Thus, this force may vary with different operators and also in accordance with the position in which the nail is to be driven, i.e. between a downwardly driven nail, an upwardly driven nail and a laterally driven nail, for which the gravitational force of the weight of the tool may vary from assisting the movement of the nose piece to opposing it. Thus, the force which the operator must supply differs considerably. Other problems have arisen in connection with the practical application of such a construction to a tool for driving nails, including erratic starting of the ram, undue wear at the impact points of the rotating flywheels, the tendency for the production of forces which deflect the ram laterally, absence of equalization of the engagement forces of the two flywheels, accidental starting of the ram by the stationarily mounted, rotating flywheel, difficulty in disengagement of the ram from the stationarily mounted, rotating flywheel, a tendency for the rotating flywheels to "grab" the sides of the ram, difficulties in producing a smooth acceleration of the ram and undue losses in power effectively transmitted to the ram. Other problems included difficulties in returning the ram to its initial position, including localized elongation of a coil spring and frequent breakage of a rubber cord attempted to be utilized for that purpose. As a result, there has been difficulty in consistent reproduction of the desired nail driving characteristics. The electrically driven impact tool of this invention is designed to overcome the foregoing difficulties, as well as to provide additional novel features.

SUMMARY OF THE INVENTION

The impact tool of this invention overcomes the problem of unbalanced wear and accuracy in guiding a ram, as well as more effective acceleration of the ram, by pivoting the rotating bodies or flywheels inwardly toward the stationary ram from both sides, and for equal distances. The frictional engagement of the rotating bodies with the ram takes place essentially simultaneously from both sides, producing substantially the same wear on both sides of the ram. The rotating bodies or flywheels are also mounted in an overhang or cantilever arrangement with respect to the driving motors and thus permit greater freedom of access to the ram and positioning of guide rods or the like for the ram. The initially engaged surfaces of the ram are each slightly tapered, as on the order of 0.010 to 0.025 inch, preferably 0.015 inch, for one-half inch of length, insuring not only a more uniform frictional engagement on each side, but also an essentially smooth initial acceleration. The initial tapered surfaces also contribute to regeneration or "feedback" by the increase of width of the distance between the flywheels and a consequent increase in the normal force between the flywheels and the sides of the ram, thereby increasing the driving force as the ram is speeded up. Thus, there will be produced a larger force with which the flywheels grip the ram between them, as the flywheels pass along the tapered portions to the parallel portions of the sides of the ram. The taper of the initially engaged surfaces of the ram should, of course, be less than that at which the flywheels tend to "grab" the ram, rather than a smooth frictional engagement. The sides of the ram are beveled at the opposite end, but at a considerably greater angle than the taper of the initially engaged end, to produce disengagement of the flywheels from the ram and also to facilitate the return of the ram between the spinning flywheels. Normally, of course, the number of revolutions will diminish as the ram is driven on its impact stroke, but the flywheels will begin to accelerate as soon as the ram has been disengaged. Of course, the flywheels are returned quickly to their initial position after disengagement from the ram, as by a spring acting against both pivoted motors or against each. Coil springs are suitable for this purpose, but unsuitable for returning the ram, since the distance of movement of the motors and flywheels is considerably less than that of the ram and the rate of movement of the motors and flywheels is less than that of the ram. The angles of the initial flywheel centers to the centerline of the pivots and the taper of the initial engagement surface of the ram are correlated to produce a regenerative action, such as the ram taper being on the order of that expressed above, and the initial angle of the flywheel centers being within the range of a minimum of 9° to a maximum of 20°, with a range of 10° to 14° being preferred.

A balanced pull on the two pivoted motors simultaneously, to move the flywheels into engagement with the ram, is produced by a pair of electrical solenoids, which are more readily controlled and vastly quicker in action than a nose piece pressed against a work piece. Also, a power supply booster may be used to produce a high amperage pulse to increase considerably the speed of movement and initial pull of the solenoids. Each of the solenoids acts through a pair of pivotally connected links, to maximize the force which presses the flywheels against opposite sides of the ram. Thus, the links, in a straight line position, have a leverage ratio of almost infinity, which, of course, decreases as the links are bent toward each other. However, the pull of the solenoids is essentially the reverse, being least when the solenoids are just starting movement and becoming greater as the solenoids move. Thus, the effective leverage of the links counteracts the variation in the pull of the solenoids. The movable ends of the two sets of links are connected together for equalization of movement and simultaneous transmission of movement through cables connected to the pivoted motors, movement of which produces a corresponding movement of the flywheels. Also, cable connections between the solenoids and the center pivot of the corresponding toggle links has been found advantageous, with aircraft type cable being suitable.

As an alternative, a single solenoid may act through a single set of links, or through a cable arrangement including a first cable fixed at one end and attached at the opposite or movable end to the cables connected to the pivoted motors. A second cable, pulled by a solenoid, is connected to an intermediate point on the first cable and exerts a pull transverse to the first cable. A third cable, also transverse to the first cable, is anchored at one side and is connected to the movable end of the first cable. When the solenoid pulls on the second cable to shorten the effective length of the first cable, with the third cable maintaining the movable end of the first cable in alignment with its fixed end, the cables connected to the motors are also pulled to move the flywheels into engagement with the ram. A similar cable arrangement may be substituted for each of the link pairs used with two solenoids, as described above.

An equalization of large normal forces required to drive the ram, as well as precession forces between the motor armatures and flywheels, rotating in opposite directions, has been accomplished by the use of a tension rod connecting the pivot shafts on which the motors and flywheels are pivoted. This tension rod is located adjacent the flywheels and overcomes the necessity for the housing to equalize these forces, thereby reducing considerably the necessary thickness and weight of the housing or permitting the housing to be made of molded plastic, rather than formed aluminum. In addition, the tension rod provides a stable means for maintaining the spaced position between the pivot shafts. A pair of spaced tension rods, the other at the opposite ends of the motors, may also be utilized. The characteristics of the flywheel inertia, the ram inertia, the probable rate of ram wear and the motor recovery rate, such as from 7,000 to 14,000 r.p.m., are matched to provide adequate acceleration of the ram with a reasonable amount of wear.

The problem of the shorter life and delay in reaction of a normal coil spring, for returning the ram to its initial position, after completion of the impact stroke, or breakage of a single rubber cord for the same purpose, has been overcome by the use of a bundle of elastomer cords, such as rubber cords, placed in a nylon sheath. Such elastomer cords tend to stretch throughout their length upon the imposition of a force tending to elongate them, rather than stretching one increment at a time, as in the case of a coil spring subjected to an extremely short time period of ram movement. The ram is formed of a lighter weight material, such as aluminum, but a steel driver blade, which produces the actual impact, is attached to the ram.

A brake lining on the sides of the ram provides a friction surface for the flywheels. The brake lining may be bonded by an epoxy resin to the sides of the ram for adequate retention of the friction surface to the ram. Also, the ram may be provided with wings, which engage guide rods and have a greater surface area for abutment against a bumper. In order to cool the frictionally engaging parts, the motor is equipped with a fan for blowing air past the flywheels and ram, while this air is filtered to prevent foreign material from collecting on the friction surface. As an alternative, the friction surface, such as brake lining, may be bonded, as by an epoxy resin, to the periphery of each flywheel, in order to provide a greater cooling effect on the friction material, due to rotation of the flywheel. However, it is preferred to bond a mixture of a resin, such as polyurethane or phenolic, with asbestos fibers, as friction material to each flywheel. Such a resin mixture may also include particles or elongated fibers of copper or other material having a relatively high heat conductivity.

A safety device actuated by a slide on the nose piece may control a microswitch which must be closed by movement of the slide engaging the work piece, before the flywheel pivoting solenoids can be energized. An alternative or additional safety device includes a movable stop block which is normally in a position preventing downward movement of the ram but moved away from this position through a rod actuated through movement of the nose piece slide through engagement with the work piece.

The controller for the motors is selected to cause as great acceleration as possible after the motors and flywheels have slowed down after moving the ram on an impact stroke, but to limit the top speed of the motors to a speed consonant with the kinetic energy to be transmitted to the ram for driving the size and length of nail into the type of wood or other material of the work piece, such as through steel into concrete. The motors are preferably selected so that the maximum obtainable speed exceeds any speed to which it might be desirable to limit the motors for any expected application. Such a controller may be selected so that it can be adjusted to limit the maximum speed of the motor to a greater or lesser speed, when different nails or different work piece materials are encountered. Also, substitute flywheels, such as adapted to produce different weights, may be used for such different applications. For this reason, it is desirable that access to, removal of and substitution of different flywheels and/or rams should be expedited by the mounting of these parts and the construction of the enclosing housing.

An embodiment of this invention which includes the above elements and features, as well as certain variations, is illustrated in the accompanying drawings, in which.

Figure 10:
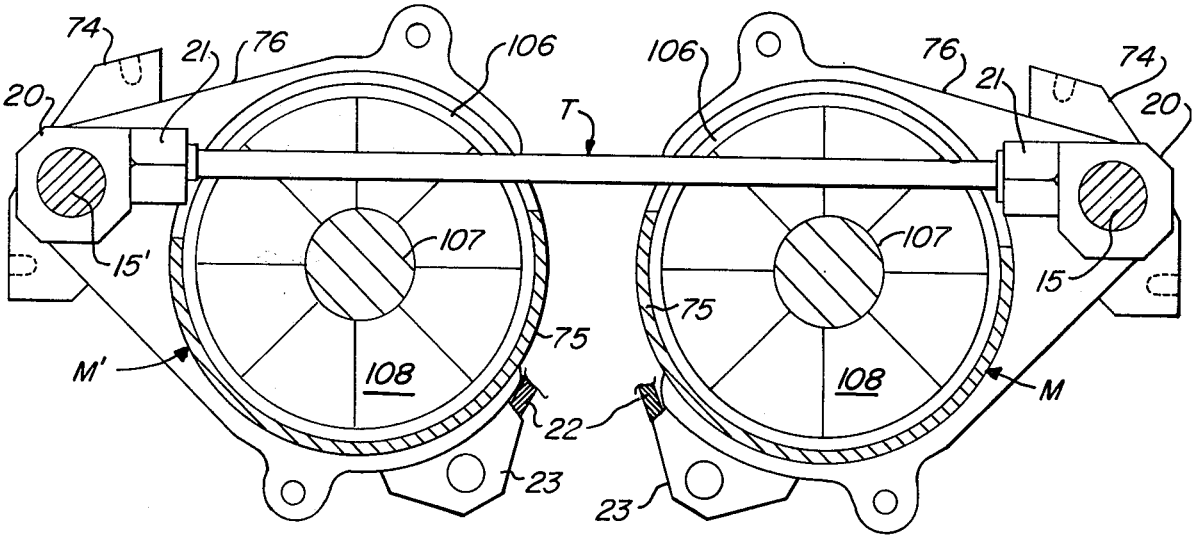
FIG. 10 is a cross section taken along line 10—10 of FIG. 9.
Figure 10A:
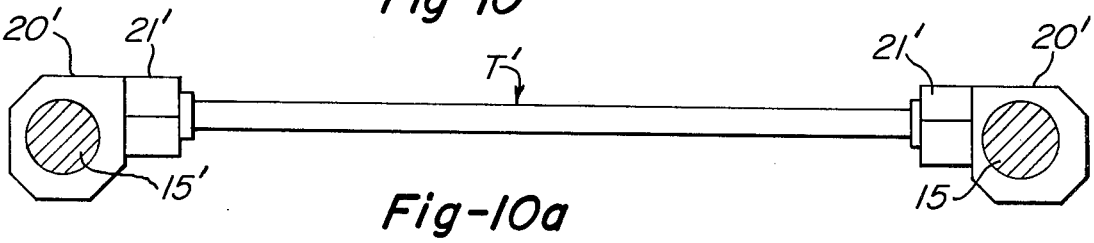

FIG. 10*a* is a cross section taken at the opposite end of the motor and showing an alternative construction.

Figure 11:
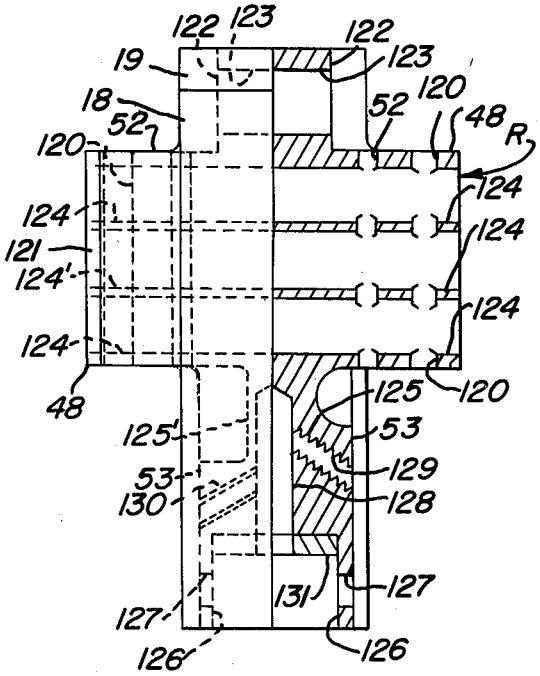

FIG. 11 is a side elevation, partly in central longitudinal section, of a ram which is engaged and accelerated by the flywheels.

Figure 12:
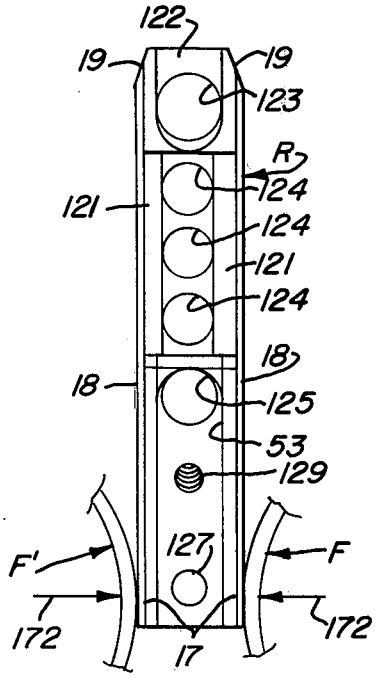

FIG. 12 is an end elevation of the ram of FIG. 11, with the flywheels shown fragmentarily in the position of initial engagement with the ram.

Figure 13:
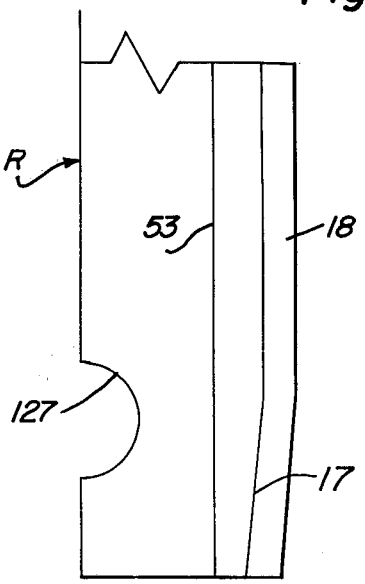

FIG. 13 is an enlarged view corresponding to a portion of the lower end of the ram, as shown in FIG. 12, to illustrate a slight taper.

Figure 14:
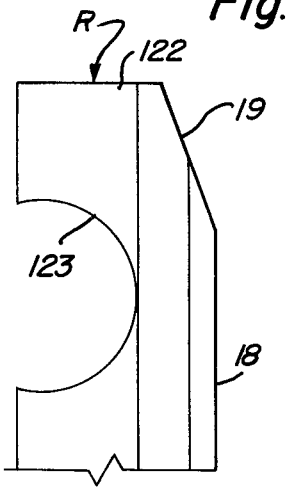

FIG. 14 is a similar enlargement of a portion of the upper end of the ram, illustrating the bevel which produces disengagement of the flywheels with the ram, as the ram reaches the normal end of its travel.

Figure 15:
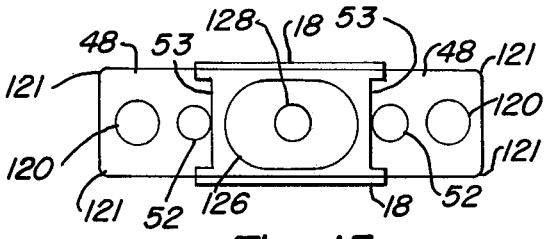

FIG. 15 is a bottom view of the ram of FIG. 11.

Figure 1:
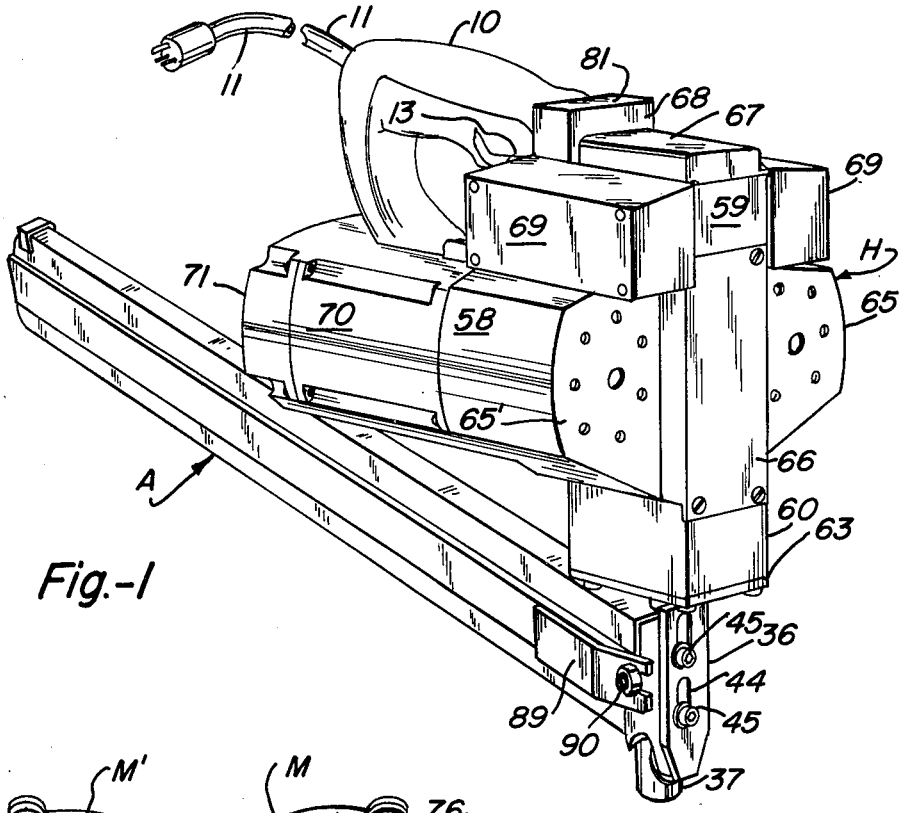
FIG. 1 is a perspective view of an impact tool of this invention embodied in a nail driving machine.
Figure 3:
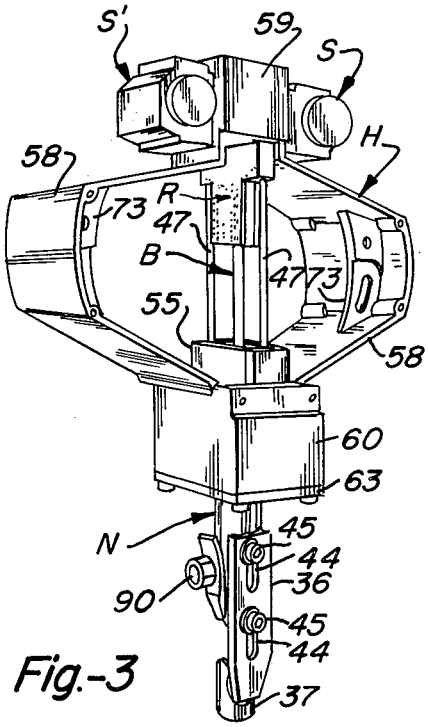
FIG. 3 is a perspective view of a housing, with certain parts installed on the housing, the housing being particularly adapted to receive the rotating flywheels of FIG. 2.
Figure 16:
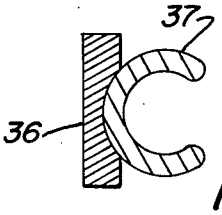

FIG. 16 is a cross section, on a slightly larger scale, of a nose piece slide, shown also in FIGS. 1 and 3.

Figure 17:
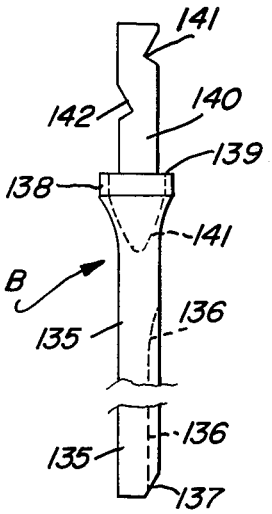

FIG. 17 is a condensed side elevation of a driver blade which is attached to the ram for driving nails.

Figure 18:
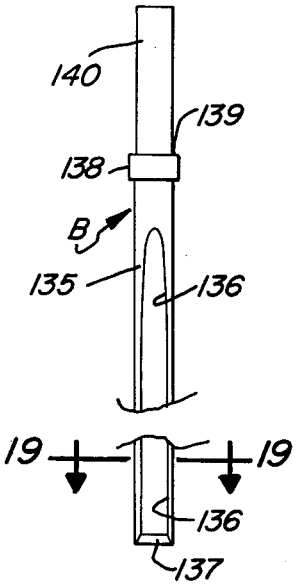

FIG. 18 is a condensed rear elevation of the driver blade of FIG. 17.

Figure 19:
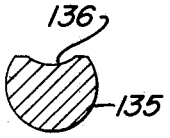

FIG. 19 is a cross section, on an enlarged scale, taken along line 19—19 of FIG. 18.

Figure 2:
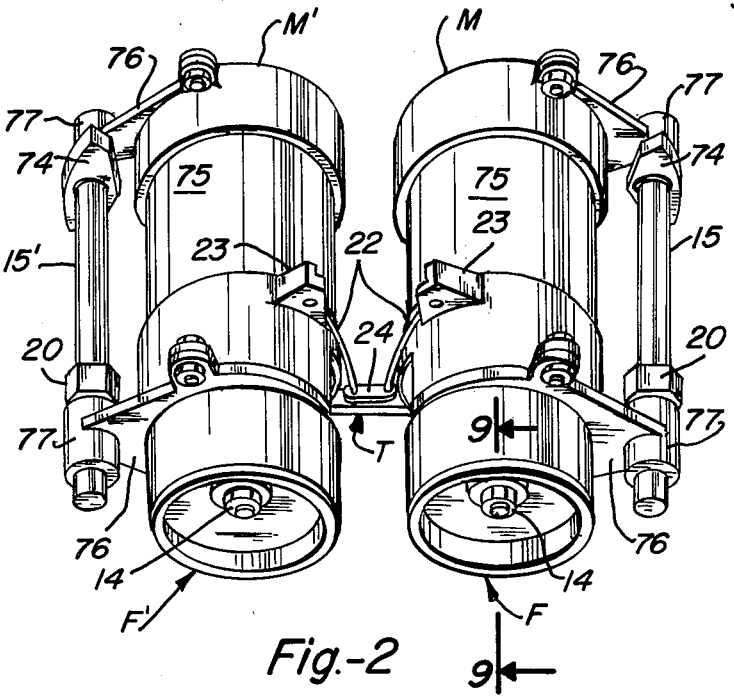
FIG. 2 is a bottom perspective view of a pair of opposed, pivoted, oppositely rotating bodies, each comprising a flywheel, and motors for rotating the flywheels.
Figure 9:
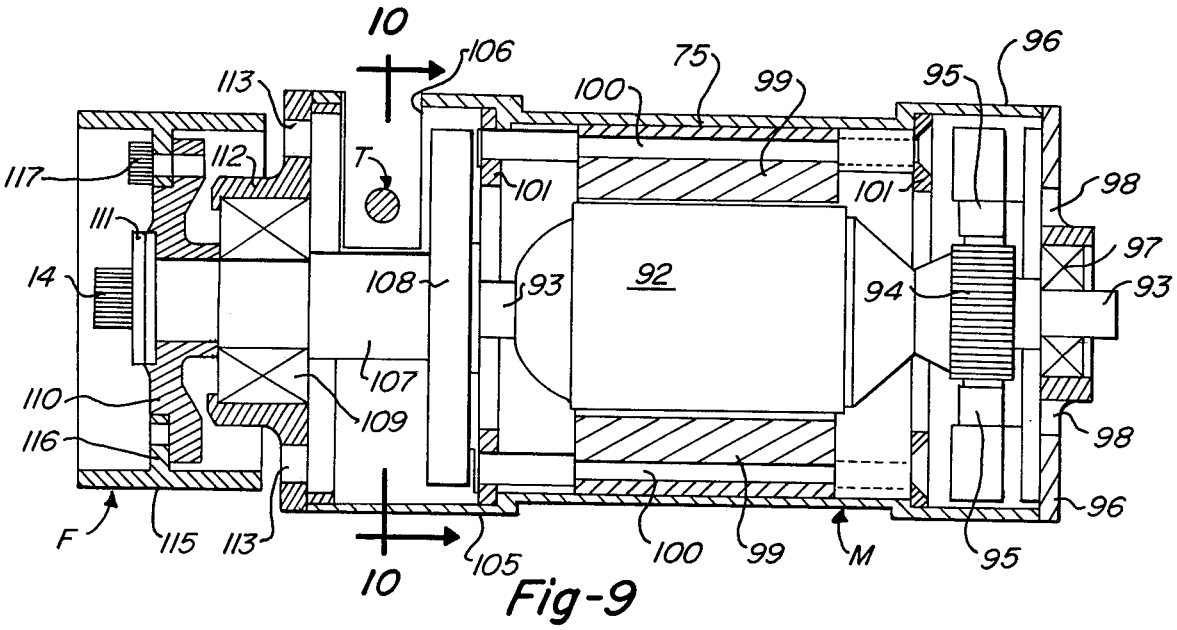
FIG. 9 is a longitudinal section taken along line 9—9 of one of the motor and flywheel assemblies of FIG. 2, but on an enlarged scale.
Figure 20:
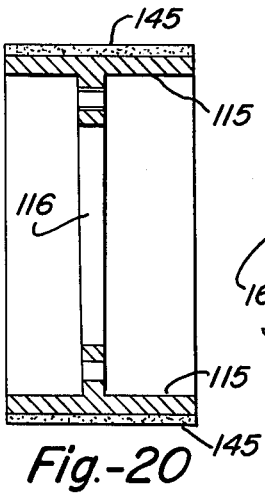

FIG. 20 is a longitudinal section of a flywheel alternative to those of FIGS. 2 and 9.

Figure 5:
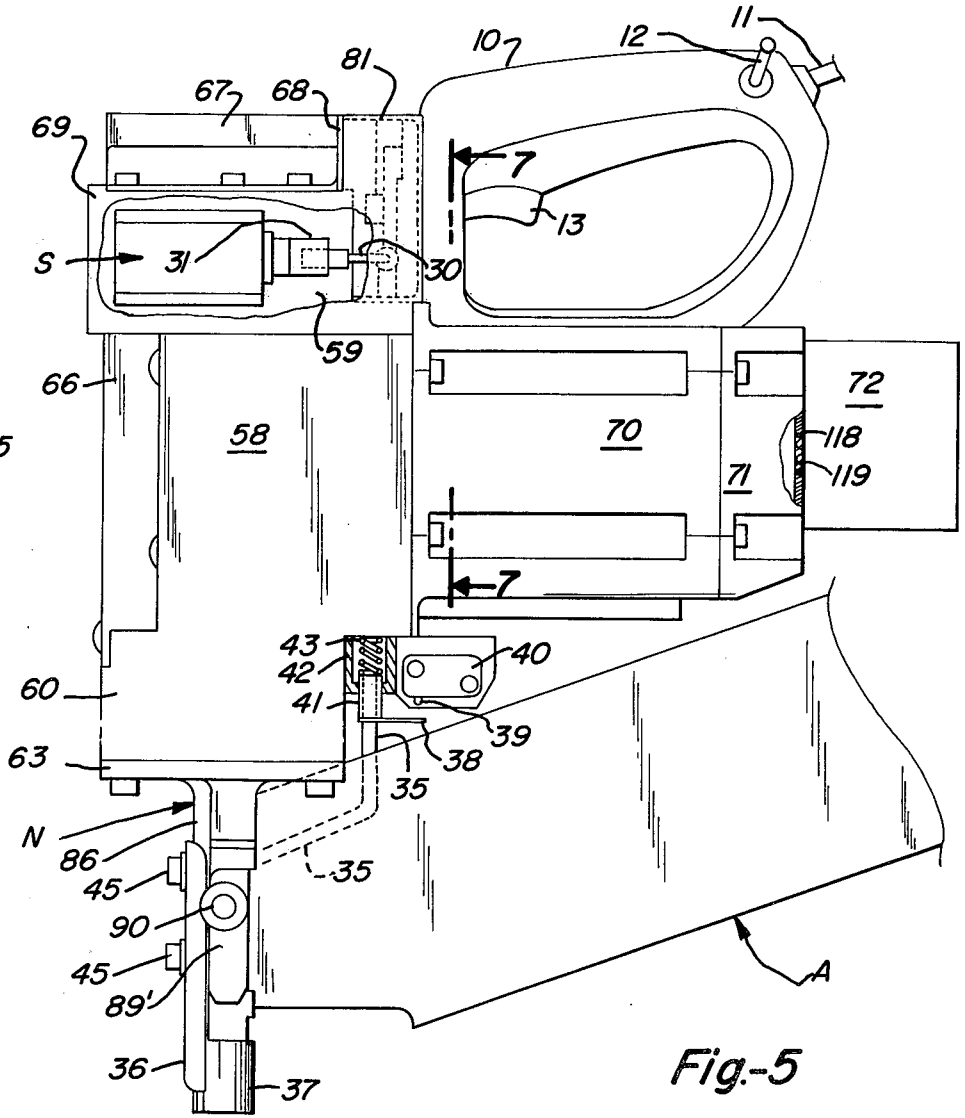
FIG. 5 is a side view of the machine of FIG. 1, but taken from the opposite side than FIG. 1 and with a portion of a nail feed magazine omitted.
Figure 21:
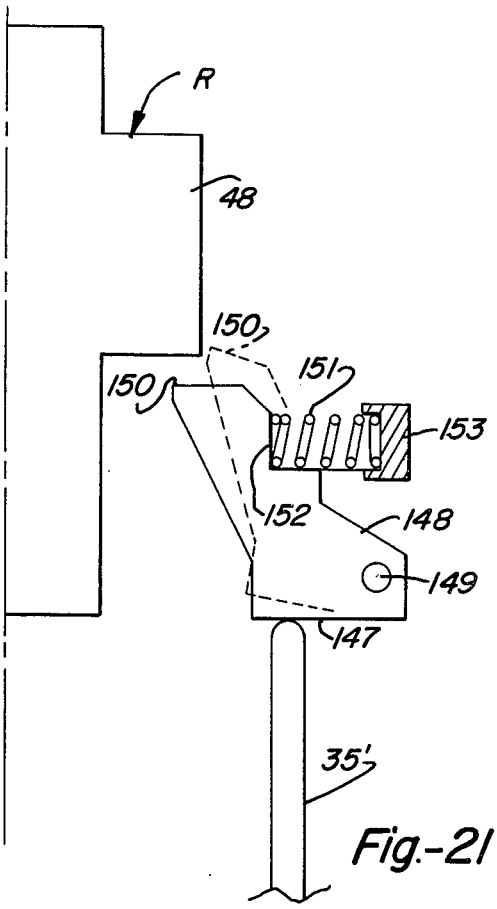

FIG. 21 is a fragmentary view, on an enlarged scale, showing a safety mechanism, alternative to or in addition to that shown in FIG. 5.

Figure 22:
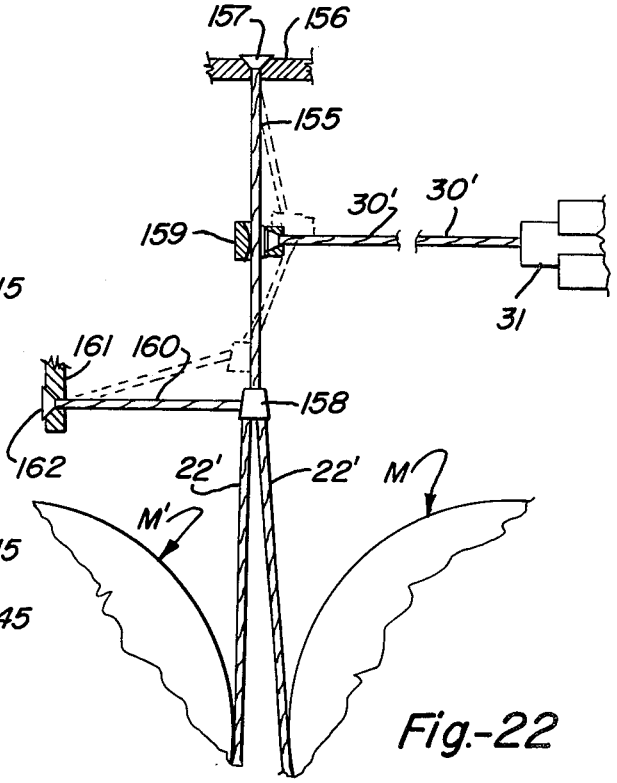

FIG. 22 is a fragmentary, diagrammatic view illustrating a cable arrangement for use as an alternative force multiplying means of a device for pivoting the motors and flywheels.

FIG. 23 is a fragmentary end elevation of a further alternative safety mechanism.

FIG. 24 is a fragmentary side elevation of the safety mechanism of FIG. 23.

FIG. 25 is an enlarged view corresponding to FIG. 13 but showing a modified manner of providing a slight taper.

DETAILED DESCRIPTION OF THE INVENTION

Figure 6:
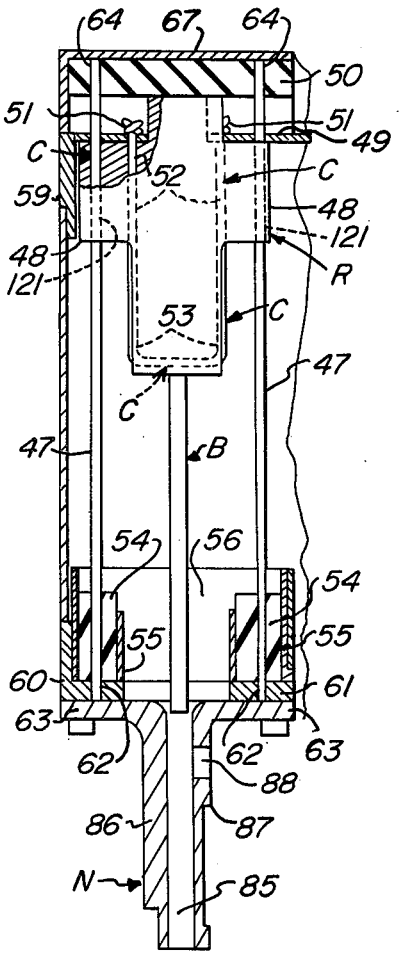
FIG. 6 is a partial longitudinal section taken along line 6—6 of FIG. 4, with certain exterior parts omitted for clarity of illustration.

An impact tool of this invention, illustrated as embodied in an electric nail driving tool, includes generally a housing H of FIG. 1 having a nose piece N through which the nails are driven into the work piece by a driver blade B of FIG. 6 attached to a ram R which is engaged by rotating bodies or flywheels F and F′ of FIG. 2, pivoted into simultaneous engagement with the opposite sides of the ram for propelling the ram and driver blade longitudinally toward the nail. Flywheels F and F′ are rotated in opposite directions by electrical motors M and M′, the armatures of which may also supply a portion, as on the order of 10%, of the kinetic energy or inertia available for transmission to the ram by the flywheels. Solenoids S and S′ of FIG. 3 are utilized, with linkage mechanism and cable connections described below, to pivot the flywheels toward the ram. A nail feeding magazine A of conventional construction is attached to the nose piece N for moving the nails, in turn, in position to be driven into the work piece, by blade B. The housing H is provided with a handle 10 by which the tool may be held for placement in a desired position against the work piece, with electricity being supplied through an electrical cord 11 and an on-off switch 12 of FIG. 5 which, when on, causes current to be supplied to motors M and M′. The solenoids S and S′ are actuated only when a trigger 13, provided on the handle, is closed, subject to a safety device described below which precludes the accidental discharge of a number of nails into the air if the trigger is accidentally pressed. The respective motors M and M′ rotate the corresponding flywheels F and F′, which are brought up to a predetermined speed, correlated with the weight of the ram and the necessary inertia of the flywheels for producing an adequate number of foot pounds to drive each nail in turn. Each motor M or M′ is provided with a shaft, to the overhanging end of which the corresponding flywheel F or F′ is attached by a cap screw 14, as in FIG. 2, while the motors are pivoted on spaced pivot shafts 15 and 15′ disposed in spaced, parallel relation and at equal distances from the centerline of movement of the ram R. In accordance with this invention, the motors and flywheels are pivoted concurrently and simultaneously toward each other for simultaneous engagement of the flywheels with the opposite sides of the ram R, adjacent the lower end of the ram R, as viewed in FIG. 6 and assuming that the tool is held in an upright position above the work piece, it being understood that the tool may be held in a horizontal position, as for driving a nail into an upright work piece, or even in an upward position, as for driving a nail into an overhead work piece.

Also in accordance with this invention, the entrance edges of the sides of the ram R, as in FIGS. 12 and 13, are each provided with a taper 17 at an angle selected such that the fly-wheels will engage the ram quickly, but will smoothly impart acceleration thereto. A layer 18 of friction material, brake lining being highly suitable, will follow the angle of tapers 17. Such entrance taper may also be provided in layer 18 of the friction material, as at 17′ in FIG. 25, as in both layers on opposite sides of the ram. An initial engagement of flywheels with parallel sides of a ram tends to produce a grabbing effect and considerable wear at the point of initial engagement. However, the initial taper of the sides, such as a taper of 0.010 to 0.025 inch, preferably 0.015 inch, in a length of one-half inch, permits the flywheels to start the ram on its movement more smoothly and with less slippage, as well as with a greater rate of increase in acceleration, due to the slight wedging action of the tapered sides, as the ram begins to move and there is little or no tendency for the flywheels to produce wear at one point.

The gripping force of the flywheels produced by the entrance taper on opposite sides of the ram is most pronounced when both flywheels are moved simultaneously into engagement with the ram, since the inertia of each flywheel resists the tendency for the initial taper of the sides to push the flywheels apart, as the ram starts its movement produced by the flywheels. This inertia produced force would not be present if a flywheel, which is fixed, were used on one side of the ram and a spring pressed roller on the opposite side, since a fixed center flywheel is unable to exert any inertia effect on the ram, while the opposed roller would not rotate until started by movement of the ram and therefore has a negligible inertia. Similarly, the use, on the bottom of a cylindrical ram having a conical point, of a fixed motor driven roller and, on the top, a motor driven roller supported by springs, while pushing the ram between the rollers, does not produce the desired results, since there is a necessity for a starting force, i.e. the ram would not be self starting. Also, the lower fixed roller is again incapable of exerting inertia against the ram and the upper roller can, at best, exert only one half the inertia of a similar rotating body on each of the opposite sides of the ram. Since a greater gripping effect, due to the wedging action of the tapered sides, is produced as the ram moves, there is an adequate normal force to produce additional acceleration as the flywheels move from the tapered portions to the parallel portions of the sides of the ram. The opposite end of the ram R, as in FIGS. 12 and 14, is provided with a disengagement bevel 19, on each side, which has a considerably greater inclination than the slightly tapering surfaces 17, and permits a quick disengagement of the ram from the rotating flywheels, so that the ram may quickly stop and be returned, normally upwardly between the flywheels.

An additional feature of this invention is the tension rod T of FIGS. 2 and 10, connected between the pivot shafts 15 and 15' for the motors, as by connectors 20. The ends of rod T may be oppositely threaded for adjustment into hexagon blocks 21 of connectors 20. Tension rod T equalizes the large normal forces required to drive the ram, thus relieving the housing of the necessity for equalizing such forces. The tension rod also equalizes the precession forces and the rotational and acceleration reaction forces produced by the counter-rotating motor armatures and fly-wheels. An additional tension rod T', shown in FIG. 10*a*, may connect shafts 15 and 15' at the opposite end of the motor through connectors 20' on shafts 15, 15' and having hexagon blocks 21'.

Figure 4:
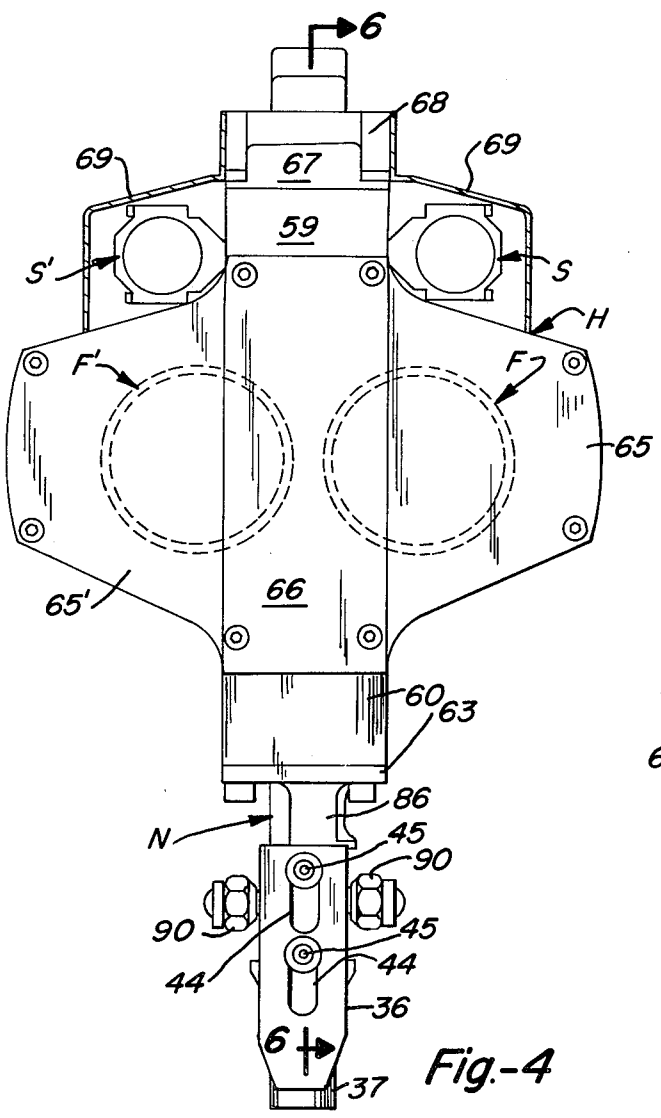
FIG. 4 is an end view of the machine of FIG. 1.
Figure 7:
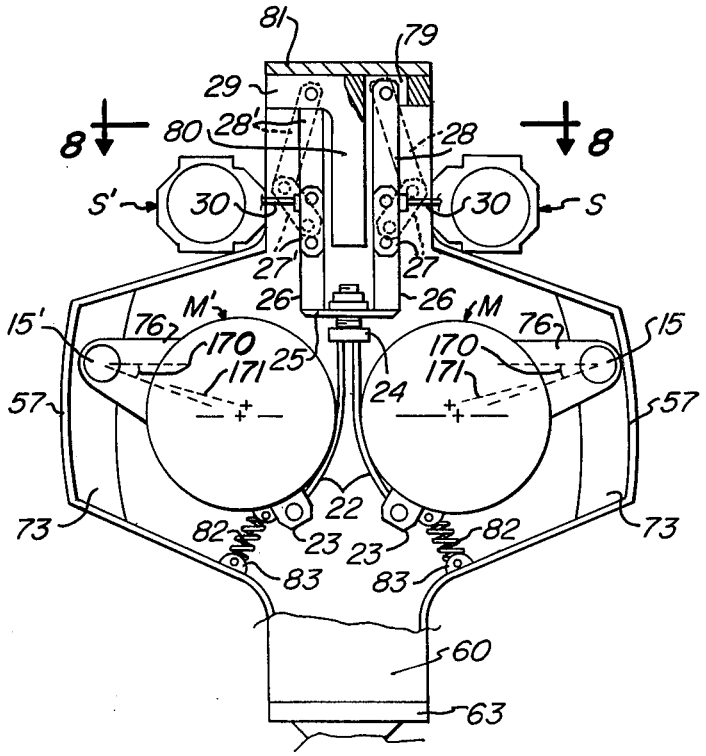
FIG. 7 is a cross section taken through the motors, along line 7—7 of FIG. 5, showing particularly the device for pivoting the motors and flywheels.

A further feature of this invention includes the simultaneous pivoting of the motors M and M' and flywheels F and F', along with them, through the action of solenoids S and S' mounted in the housing H, as in FIGS. 3–5, through a linkage and cable arrangement, including cables 22 connected to motor brackets 23, as in FIG. 2, and in turn connected to a block 24. Block 24, as in FIG. 7, is adjustably connected to a yoke 25 whose spaced arms 26 are each pivotally connected to the adjacent end of an inner link 27 or 27'. In turn, each inner link 27 or 27' is pivotally connected to an outer link 28 or 28', respectively, the opposite end of which is pivotally connected to a support block 29. A solenoid cable 30, as in FIG. 8, connects the respective solenoid plunger 31 with a socket 32 at the pivotal connection of the links 27, 28 and 27', 28'. Each solenoid cable 30 passes over a pivoted, arcuate pulley 33 which transfers the pull of the respective solenoid plunger through 90°, to pull the respective pivot centers between the links away from each other, as in the direction of the arrows of FIG. 8. As will be evident, such movement essentially moves the links 27, 28 and 27', 28' from the full to the dotted positions of FIG. 7. In turn, this will move the yoke 25 and motor cables 22 upwardly, as viewed in FIG. 7, to pivot the motors M and M' toward each other about the shafts 15 and 15', to produce a corresponding movement of the flywheels F and F' toward each other and produce engagement of the flywheels with opposite sides of the slight tapers at the initial contact end of the ram R. As described previously, this engagement of the flywheels with opposite sides of the ram R will start the ram moving in an impact direction, with the acceleration increasing as the flywheels move along the slightly tapered surfaces and continue to engage the parallel sides of the ram, until the disengagement bevels 19, at the opposite end of the ram, are encountered. Such impact of the ram will also move the driver blade B into engagement with the head of the nail and drive the nail into the work piece.

A safety device for preventing actuation of the solenoids S and S' and a resulting impact movement of the ram, until the tool is in position against the work piece, may include an angular rod 35 of FIG. 5 attached to a slide 36 mounted for movement along the nose piece N and provided with a partial ring 37, shown also in FIG. 16, adapted to be pressed against the work piece, when the operator desires to produce another impact, as for driving another nail. An upper portion of rod 35 is provided with a plate 38 adapted to engage a button 39 of a microswitch 40 when the rod 35 is moved upwardly, as viewed in FIG. 5, due to engagement of ring 37 with the work piece. An enlargement 41 of the upper end of rod 35 extends into a socket 42 for engaging a coil spring 43 which returns the rod 35 and slide 36 to their initial position, when the ring 37 is no longer pressed against the work piece. Microswitch 40 is mounted on the housing adjacent the socket 42, while pressure plate 38 on button 39 will close the microswitch and complete the electrical circuit to solenoids S and S', when the operator presses the trigger 12. As in FIGS. 3 and 4, slide 36 is provided with slots 44 through which bolts 45 extend, for guiding the slide in its movement, such as upwardly and downwardly, as viewed in FIGS. 4 and 5.

During its upward and downward movement, the ram R is guided by a pair of spaced, parallel rods 47, as in FIG. 6, extending through a pair of wings 48 of the ram which extends both above and below the wings in a generally rectangular configuration in cross section. The upper end of the ram, in the initial position shown, extends through a corresponding slot in a fixed attachment plate 49 for a flexible cord C and into engagement with a resilient upper bumper 50. The flexible cord C is formed of a series of elastomer cords, such as rubber, encased in a nylon sheath. The cord C, as indicated previously, stretches equally along its length when an elongation force is applied to it, which property is particularly desirable for the present use, since the rapidity with which the ram is impelled, such as moving over its length of travel in a few milliseconds, tends to deform coil springs, the use of which has been attempted. The latter tend to elongate in increments as the stress is applied to the spring, which is reasonably satisfacory for an elongation stress applied much more slowly, but tends to overstress and deform the spring when the elongation stress is applied as rapidly as it must be for the movement of the ram to be effective in developing the desired amount of power for the impact stroke, such as for driving nails. Each end of the cord C extends through a hole therefor in the attachment plate 49, as shown, and is attached to the plate, as by a suitable fastener or being tied in a knot 51 above the plate. Cord C extends through holes 52 in the wings, indicated also in FIG. 11, along slots 53 below the wings and is looped through the lower end of the ram. As the ram R moves downwardly, the impact of the driver blade B against the nail will drive the nail into the work piece, and the head of the nail in the work piece will ordinarily stop the driver blade and ram. However, if the ram has excess kinetic energy, the underside of the wings 48 will engage lower bumpers 34 which surround the guide rods 47, correspond in area to the underside of the wings and will absorb the remaining kinetic energy. The lower bumpers are formed of resilient but tough material, such as rubber, or a hard plastic, such as polyurethane having a hardness of 80–90 Shore. Lower bumpers 54 are maintained in the desired parallel relation on the guide rods by a sleeve 55 which surrounds each of the bumpers 54 and is provided with a central aperture 56 into which the lower portion of the ram moves, as the ram is driven downwardly. Additional details of the ram construction will be given below.

The housing H, as in FIGS. 1, 3, 4 and 5, may include a forward section having a lateral wing 58 closing each side and in which the motors M and M′ and flywheels F and F′ are installed. Above the wings is a hollow, rectangular extension 59 on opposite sides of which the solenoids S and S′ are mounted, as in FIG. 3, while below the wings is a rectangular extension 60 having a bottom 61 of FIG. 6 having a central aperture corresponding to the aperture 56 of sleeve 55, as shown, and holes 62 beneath bumpers 54 into which guide rods 47 extend, for abutment by attachment flange 63 of nose piece N. The opposite ends of guide rods 47 extend into corresponding holes 64 in upper bumper 50. Thus, the guide rods 47 for the ram R and attached driver blade B extend centrally of this housing section and between extensions 59 and 60. Cover plates 65 and 65′ having apertures, as shown, for outflow of cooling air moved through and around the motors and rotating flywheels, close the front of the two wings 58 of the front housing section, while a front box 66 covers the central portion thereof. Covers 65 and 65′ and box 66 are conveniently integral. A top cover 67 closes the top of the upper extension 59 of the winged housing section, and a flange 68 upstands from the rear edge thereof, while cover boxes 69 for the solenoids are positioned at opposite sides thereof. Upper bumper 50 is attached to the underside of cover 67, which may be removed, along with front box 66 and plates 65, 65′ attached thereto, to permit removal of plate 49, which normally rests on a shoulder formed in the wall of extension 59, and ram R along with guide rods 47, as for inspection or replacement of the ram. Also, removal of front box 66 and plates 65, 65′ permits access to flywheels F and F′, as for changing through removal of cap screws 14.

Rearwardly of the front section, a hollow motor housing section 70 corresponds in contour to the wings 58 and is attached to the rear thereof, with an end cap 71 closing the cavity. A motor control assembly box 72, as in FIG. 5, extends rearwardly from the central portion of end cap 71. Mounting ribs 73, as in FIG. 3, are formed on the inside of each wing 58 and receive the end of the corresponding pivot shaft 15 and 15′ adjacent the flywheels F and F′. An attachment lug 74 at the opposite end of the corresponding pivot shaft 15 and 15′ is attached to the inside of housing section 70 at an appropriate position. A housing 75 of each motor is pivotally connected to the respective pivot shaft by brackets 76, shown also in FIG. 10, and each provided with a bearing 77 encircling the corresponding pivot shaft. It will be noted that end cap 71, with lugs 74 attached to housing section 70, will be subject to a portion of the normal and precession forces to be equalized by tension rod T. However, when tension rod T′ is connected between the pivot shafts 15 and 15′ rearwardly of the motors M and M′, the forces imposed on end cap 71 will become negligible and the two tension rods will tend to receive somewhat similar amounts of forces for equalization. As indicated previously, the use of tension rod T, or also rod T′, permits the housing to be lighter or to be made of less expensive material.

Figure 8:
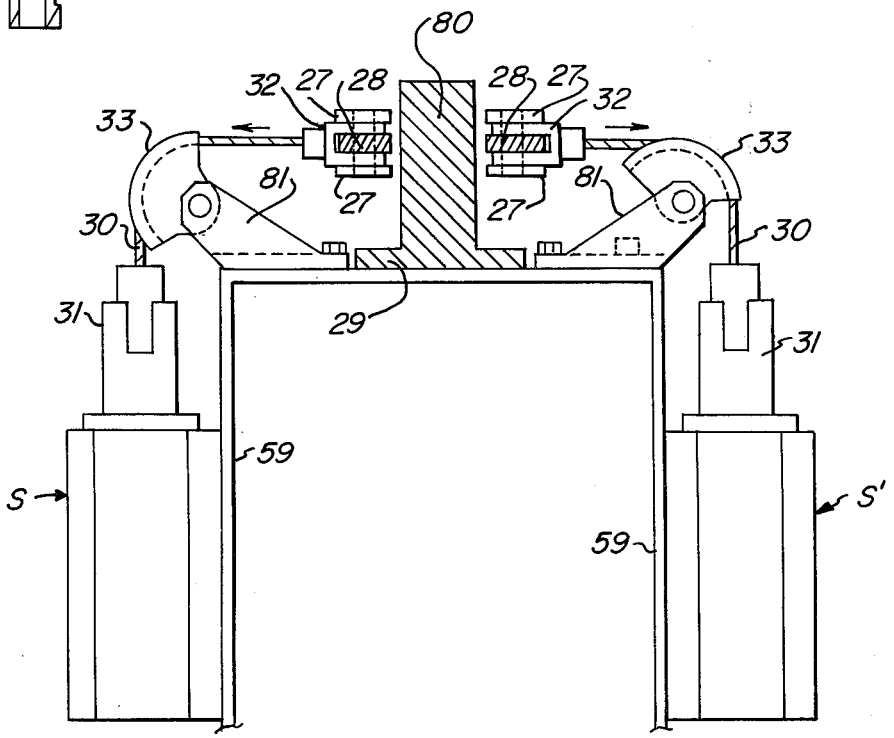
FIG. 8 is a fragmentary horizontal section taken along line 8—8 of FIG. 7, and showing particularly the cable guides omitted from FIG. 7 for clarity of illustration.

As in FIG. 8, support block 29 is attached to and extends upwardly from the rear wall of extension 59 of the front housing section. Block 29 is provided with slots 79, as in FIG. 7, through which the pivot pins for the upper ends of links 28 and 28′ extend, while a center rib 80 extends downwardly between the links. As in FIG. 5, a cover box 81 encloses support 29, rib 80 and the linkage arrangement. As in FIG. 8, the arcuate pulleys 33 may be pivoted on brackets 81 which may also be mounted on the rear side of extension 59 of the front housing section. As in FIG. 7, the motors M and M′ may be retracted by coil springs 82 connected between ears formed as parts of brackets 23 and ears 83 provided on the inside of the adjacent wing 57.

As in FIG. 6, the nose piece N is generally rectangular on the outside and provided with a cylindrical, central passage 85 of a diameter to accommodate the heads of nails placed in and driven therethrough, with a flat sided abutment 86 at the front for attachment of slide 36 thereto for movement between the extended position of FIG. 3 and the retracted position of FIG. 1. At the rear, nose piece N is provided with a slot 87 through which the shank of each nail may move and a lateral enlargement 88 of the slot to accommodate the head of the nail. The nails are conveniently secured together in side by side relation between spaced pairs of strips of tape, as of paper, with plastic or the like between the tapes and molded against the nails. Such a strip of nails slants downwardly to one side, corresponding to the angularity of the feed magazine A to the nose piece N, through which the nails are fed in succession into the nose piece in a conventional manner. The front end of feed magazine A is attached to the nose piece N by brackets 89 and 89′, secured to opposite sides of the nose piece by bolts 90, as shown.

As in FIG. 9, each motor includes an armature 92 mounted on a shaft 93 which carries a commutator 94 engaged by brushes 95 mounted in conventional brush holders, as shown. The brush holders are mounted in an end cap 96 for the motor which may carry a bearing 97 for the commutator end of the motor and have holes 98 therein, for flow of air into the motor. The field windings 99 of the motor are positioned by pins 100 extending between annular support rings 101. A sleeve 105 attached to the front of the motor housing 75 is provided with a slot 106 which provides clearance for the tension rod T, while a stepped enlargement 107 of the shaft carries a fan 108, which pulls air through the motor and blows it past the flywheels. The enlargement 107 continues to a bearing 109 which is larger than bearing 97, because of the additional weight and overhanging position of the flywheel, a hub 110 of which is mounted on the end of shaft enlargement 107 and retained in position by washers 111 engaged by socket head screw 14. Bearing 109 is supported within a bearing cap 112 attached to the end of sleeve 105 and also provided with holes 113, for flow of cooling air to the flywheel. The flywheel has a rim 115 mounted on the hub 110, such as through an inside flange 116 and studs 117, spaced circumferentially about the hub. As will be evident, the stepped enlargement 107 may be formed integrally with the shaft 93 or formed separately and mounted thereon by a press fit, or by brazing. Air inlet openings 118, provided with filters 119, may be provided in the rear wall of housing end cap 71, as in FIG. 5. After movement past the flywheels F and F' and ram R, the air is discharged through the holes in front plates 65 and 65'.

In addition to parts previously described in connection with the ram R, the ram is provided with additional elements, as in FIGS. 11, 12 and 15, such as holes 120 in the wings 48 for the guide rods 47 and bevels 121 on the outer edges of the wings. A groove 122 is formed at each side of the upper portion of the ram above the respective wings, for readier access to the ends of cord C and to reduce weight, while the holes in plate 49 of FIG. 6 for cord C are placed in ears of the plate which extend into the respective groove 122. A transverse bore 123, for both weight reduction and cooling purposes, connects the two grooves. Also, a series of bores 124, for similar purposes, extend laterally through the ram, within the longitudinal extent of the wings and intersect the holes 52 and 120, as in FIG. 11. The side grooves 53 which receive the cord C are widened for weight reduction purposes, while sockets 125 and 125' on opposite sides of the ram connect with the respective groove 53 adjacent the wings. A socket 126, enlarged as in FIG. 15, extends upwardly from the lower end of the ram, and connects holes 127 through which the cord C extends to cross socket 126. From the upper edge of the latter, a central socket 128 extends upwardly, to receive the upper end of the driver blade B, as through set screws tightened in tapped holes 129 and 130, inclined upwardly toward the driver blade from opposite sides. Since the ram is preferably formed of aluminum or other lightweight metal and the driver blade is preferably formed of alloy steel, a steel plate 131 having a central hole corresponding in size to socket 128 is positioned against the upper surface of socket 126 to transmit forces received from the driver blade over a large area and thereby avoid crushing the surface of aluminum or the like. Cord C may pass around either the front or the back of the driver blade.

The driver blade B, as in FIGS. 17–19, includes an elongated shank 135 having on one side a groove 136 and a bevel 137 at the impact end of the shank. The blade is preferably positioned so that the groove 136 and bevel 137 will face the incoming nails, so that, if the next nail tends to enter the nose piece N before the blade has been returned following an impact stroke, the head of the nail will tend to be cleared by the groove and bevel. The shank is provided with an enlargement 138 at the opposite end, providing a shoulder 139 around a stem 140. The stem may be made separate from the shank, as by forging, and an enlarged lower end 141 of the stem placed in a corresponding socket formed in the shank enlargement 138. The stem and shank may be attached together by forging or by brazing, or in any other suitable manner. The stem 140 is also provided with oppositely disposed, staggered notches 141 and 142 which correspond in position to the tapped holes 129 and 130 of the ram R, as in FIG. 11. Thus, the notches 141 and 142 are engaged by the set screws threaded into the tapped holes 129 and 130, respectively. The stem of the driver blade extends through the hole in plate 131 and into the socket 128 of the ram, until the shoulder 139 abuts against the plate 131. As will be evident, the cross sectional area of the shoulder 139 is such that, with a stem shank made of alloy steel, it may possibly crush the softer material, such as aluminum or the like, of the ram. However, the plate 131, which is also formed of steel, is adapted to receive the possibly crushing force of the shoulder 139 without deformation, and to distribute this force over the entire area of the plate 131, which corresponds to the area of the enlarged socket 126, as in FIG. 15, around the socket hole 128.

The friction layer, such as brake lining 18, bonded to the sides of the ram R, as in FIG. 12, may alternatively be bonded to the periphery of each of the flywheels F and F'. However, as in FIG. 20, it is preferred to provide the periphery of the rim 115 of each flywheel with a friction layer 145, molded onto the flywheel rim. As indicated previously, the molded friction layer 145 may be formed of a mixture of suitable resin, such as polyurethane or phenolic, and asbestos fibers, as a friction material. Fibers, powder or the like of a material having a relatively high heat conductivity, such as copper, may be mixed with the resin to enhance the dissipation of heat produced by the frictional engagement of the flywheels with the ram. When the friction layer is provided on the ram, the periphery of the flywheel rim 115 is preferably polished and as smooth as possible, since it has been found that the coefficient of friction for cold rolled steel, of which the flywheel rims may be made, will be increased when the friction surface, such as brake lining, is engaged with a highly polished surface moving at the peripheral speed of the flywheels. While such a coefficient of friction is theoretically on the order of 0.3, in practice, it may be reduced to about 0.15. However, when the friction layer is molded on or bonded to the periphery of each flywheel, the sides of the ram to be engaged by such friction surfaces, for similar reasons, are preferably highly polished and smooth. Although it would be expected that a rough surface in engagement with the friction layer would have a higher coefficient of friction, the driving results produced appear to be affected by the relatively high peripheral speed of the flywheels and the desirability of producing a smooth initial engagement, rather than a grabbing effect.

An alternative or additional safety device, as in FIG. 21, may be operated by a rod 35' which may extend upwardly from slide 36 and ring 37 in a manner similar to rod 35 of FIG. 5, or may be provided as an extension 35' of the rod extending upwardly through the coil spring 43 of FIG. 5, as indicated previously. Thus, the upper end of the rod 35' is adapted to engage a base 147 of a block 148 pivotal about a fixed pin 149. An offset nose 150 is normally positioned beneath a wing 48 of the ram R, so that if the ram is accidentally moved downwardly without the rod 35 and its extension 35' being raised by engagement of slide ring 37 with the work piece, the nose 150 will block downward movement of the ram. However, if the rod 35' is raised to pivot the block to the dotted position shown, the nose 150 will clear the side of the wing 48 and the ram will be permitted to move downwardly for the desired impact. The block 148 is normally maintained in a position with the nose 150 beneath the ram wing by a coil spring 151, one end of which abuts a shoulder 152 formed on the block and the other end of which abuts a fixed stop 153. As will be evident, if the rod 35' is retracted due to disengagement of the slide ring 37 of the work piece, the spring 151 will move the safety block from the dotted position back to the full position of FIG. 21.

An alternative force multiplying means, comprising essentially a cable arrangement, is illustrated in FIG. 22. This force multiplying means includes a first cable 155 which is connected, at its fixed end, to an anchor 156 by a plug 157. The movable end of cable 155 is provided with a connector 158, to which are attached cables 22' extending to the respective motors M and M', such as in a manner corresponding to that illustrated in FIG. 7. A second or solenoid cable 30' extends from a plunger 31 of a solenoid and is attached to a connector 159, which conveniently encircles the cable 155 at an intermediate point of the cable. Connector 159, although clamping the cable, has a longitudinal rounded inside surface opposite cable 30', as shown, to avoid injury to the cable 155 when moved by pulling. The solenoid cable 30' may extend directly from the solenoid plunger 31 or may extend around an arcuate pulley, as in the manner illustrated in FIG. 8. A third cable 160 is attached at its movable end to connector 158 and its fixed end to an anchor 161, as by a plug 162, and causes the connector 158, i.e. the movable end of cable 155, to follow an essentially straight line motion, or the equivalent thereof, when solenoid cable 30' is pulled. Such pull moves the first cable 155 to the dotted position shown, thereby to move the connector 158 upwardly, as viewed in FIG. 22, to pivot the motors M and M' and the rotating bodies or flywheels driven by the motors, toward each other, for engagement of the flywheels with the ram, as described previously. It will be noted that a dual cable arrangement actuated by a pair of solenoids may be utilized, in effect being the substitution of the force multi-plying cable arrangement of FIG. 22 for each of the pairs of links 27, 28 and 27', 28' of FIG. 7. Similarly, one of the link pairs of FIG. 7 may be substituted for the cable arrangement of FIG. 22, but including cable 160 connected as a guide for straight line movement to the free end of the inner link 27, or other suitable mechanism.

Through this invention, the weight of the flywheels has been reduced from 2.5 pounds each for the nail driving tool, constructed in accordance with Ser. No. 580,246, to 0.35 pound for each flywheel for a nail driving tool constructed in accordance with the present invention. A corresponding reduction has been secured in the weight of the complete nail driving tool itself, i.e. from 21 pounds for the previous tool, to between 11.5 and 12 pounds for a tool of this invention, for driving 16-penny nails. By the use of lighter motors, the weight of the same tool could be reducible to between 8 to 10 pounds.

In FIG. 7, the angles 170 are between the plane of shafts 15 and 15' and a centerline extending from the center of a shaft 15 or 15' to the center of the corresponding motor M or M'. The centerlines 171 approximate the position of the latter, when the motors M and M' have been pivoted, so that the flywheels will engage the opposite sides of the ram R. In FIG. 12, the arrows 172 indicate the normal force exerted by the respective flywheels F and F' against the tapered side portions of the ram. These relationships, as well as the movement of the flywheels by the solenoids and the force multiplying means, are of interest, since tests have indicated that it requires on the order of 60 foot pounds of energy to drive a 16-penny nail into pine and on the order of 110 to 120 foot pounds to drive a 16-penny nail into oak. As will be evident, the foot pounds necessary to accelerate the ram and drive the nail must be imparted to the ram by the flywheels. Calculations have indicated that it requires approximately 35 foot pounds per ounce, to accelerate the ram, so that 175 foot pounds are necessary to accelerate the 5 ounce ram used. In addition, the flywheels should transmit, through the ram, additional foot pounds, such as 60 to 120 foot pounds, depending on the wood, when driving 16-penny nails. For this purpose, the foot pounds transmitted to the ram by both flywheels thus should exceed 235 to 295 foot pounds, or 117.5 to 147.5 foot pounds for each flywheel. The pull on each cable 22 of FIG. 7 is estimated for calculations to be initially on the order of 500 to 550 pounds due to a solenoid pull on each cable 30 on the order of 100 to 150 pounds. Thus, when the flywheels reach the ram, the initial normal force against the ram, indicated by the arrows 172 of FIG. 12, should be approximately 1,000 pounds. As the flywheels drive the ram and tend to be spread apart by the taper, the normal force increases through the reaction of flywheel inertia and as the ram drive becomes regenerative, the toggle action further increases the normal force to approximately 2,500 pounds to 3,500 pounds. Then, depending upon the coefficient of friction of the friction material, the necessary driving force is developed to set the nail or the like. While the theoretical coefficient of friction for highly polished, cold rolled steel against brake lining or phenolic resin with asbestos fibers is approximately 0.3, in practice it may be found to be between 0.15 and 0.3.

For a $\frac{5}{8}$ inch clearance between the driver blade B and the head of the nail, the total movement of the ram will correspond to a distance slightly greater than the length of the nail, i.e. slightly more than 3.25 inches for a 16-penny nail, plus the $\frac{5}{8}$ inch clearance. It can be calculated that the time which the ram requires to move this distance, in order to develop the necessary foot pounds of energy for driving the nail, is on the order of 3 to 4 milliseconds. However, the pulse to the 24 volt solenoids, such as from 50 to 80 amperes at 110 volts, may be controlled to be on the order of 8.33 milliseconds, due to the time required to move the flywheels into position against the ram and a slight initial slippage. The time for return of the motors and flywheels to the initial position, return of the ram to its initial position and the acceleration of the flywheels to the speed desired prior to the next impact stroke, may be on the order of 128 milliseconds, which is considerably less time than it would require the user of the tool to reposition the tool for driving another nail. However, there may be operations, such as factory operations, involving a stationary tool in which the nails can be driven with a 128 millisecond time period between the termination of the driving of one nail and the start of driving the next nail. The 128 milliseconds is thus an approximate minimum time for the tool to be ready to drive the next nail.

In order to develop the necessary foot pounds of energy in the flywheels, it is calculated that, at 20,000 r.p.m., each 0.35 pound flywheel will be able to store approximately 250 foot pounds of energy. For lesser speeds, the stored energy decreases. Since the total of 500 foot pounds is greater than the foot pounds required to accelerate and drive the ram, as described above, the speed of the flywheels may be less, such as a speed on the order of 10,000 to 14,000 r.p.m. In addition, with the ram engaging forces available, it was found that excess slippage was apparently occurring above 14,000 r.p.m. for the flywheels, since nails driven at 14,000 r.p.m. and down to 10,000 r.p.m. would not be completely driven at speeds above 14,000 r.p.m. However, if higher ram engaging forces were available, speeds over 14,000 r.p.m. would probably be successful. In order to have ample reserve speed and also to provide acceleration at a lower speed, it may prove desirable to select a motor having a top speed of, say, 22,000 r.p.m. but a development of high torque over a lower speed range, such as 7,000 to 14,000 r.p.m. A universal type motor, for which, as the speed drops, full voltage and amperage are applied, is desirable. Also, the initial speed of the motor may be reduced by an SCR type control system, as in the motor control box 72. For battery operation, rather than electricity supplied through a cord, the motors should be selected accordingly.

As the flywheels drive the ram and kinetic energy is transferred from the flywheels to the ram, the speed of the flywheels will, of course, decrease, such as a reduction to approximately 7,000 r.p.m. at the point of disengagement of the fly-wheels from the ram, i.e. when the flywheels reach the bevels 19 of FIGS. 12 and 14. Thus, the motors should be able to increase the speed of the flywheels from on the order of 7,000 r.p.m. to 10,000 r.p.m. or 14,000 r.p.m., for example, prior to driving the next nail.

For normal forces of the magnitudes referred to, the stress on the tension rod T may be found to be on the order of 1,500 to 3,000 pounds, with an additional 10% of that amount on the end cap 71 of the housing. As indicated, with two tension rods, one intermediate the flywheels and the motors, as shown, and the other beyond the opposite ends of the motors, the stresses will tend to become more nearly equalized on both tension rods. For driving nails as large as 16-penny, the bumpers 54 of FIG. 6 may be constructed to absorb on the order of 250 foot pounds, in the event the ram is driven on an impact stroke but does not drive a nail or otherwise perform its impact function.

A further alternative or additional safety device, as in FIGS. 23 and 24, may include a link 180 mounted on an intermediate pivot 181 below the motors M and M′ and extending longitudinally below the space between the motor housings. At its rear end, the link has an upstanding arm 182 having a stop block 183 at its upper end normally disposed between the motor housings to prevent the motors and flywheels being moved toward each other and thereby deter the linear movement of the ram. A tension spring 184 pulls on the link, adjacent its front end, to maintain the link and its stop block in the normal position between the motor housings. A rod 185 is connected to the front end of link 180, while abutments 186 and 186′ on the motor housings engage stop block 183 if the motors tend to pivot toward each other. Rod 185 is connected to slide 36 by a rod similar to rod 35 of FIG. 5 and is moved upwardly by engagement with the work piece by ring 37 on slide 36 to move the front end of the link upwardly to pivot the link and move the block downwardly from between the motor housings, thereby rendering the stop block inoperative and permitting the motor housings and flywheels to be pivoted toward each other and cause the flywheels to drive the rams, when the trigger is pressed to energize the solenoids.

As will be evident, for driving different nails in different materials, or for other applications in which the foot pounds of energy desirable for an impact may vary, there are several variations which may be utilized to accommodate these differences. One variation is to use flywheels of different weights for different wood properties or other variations in kinetic energy required. Another is to utilize a motor control in which the r.p.m. of the motors may be varied, such as between the 10,000 and 14,000 r.p.m. referred to above for different woods or nails, or other variations in impact requirements. Still another is to time the pulse supplied to the solenoids, so that the flywheels will tend to disengage from the ram before the end of the ram is reached. This variation would be usable primarily when there is a large difference between the kinetic energy required for the different operations.

Although a preferred embodiment of this invention, as well as alternative constructions, have been illustrated and described, it will be understood that other embodiments may exist and that various changes may be made, without departing from the spirit and scope of this invention.

What is claimed is:

1. In an impact tool for producing an impact against an object:

(a) elongated ram means mounted for movement along a longitudinal path, in opposite directions;

(b) a pair of oppositely rotating bodies for storing energy and mounted on opposite sides of said ram means for movement toward and away from said ram path, each said body having an axis of rotation generally perpendicular to the direction of movement of said ram means;

(c) means for moving said bodies substantially simultaneously toward and into engagement with said ram means on the respective side thereof, whereby said rotating bodies impart linear movement to said ram means;

(d) said moving means including force multiplying means and means for moving said force multiplying means;

(e) said means for moving said force multiplying means being electrically actuated;

(f) means for moving said bodies away from the path of said ram means; and (g) means for returning said ram means to its initial position.

2. In an impact tool as defined in claim 1, wherein: said force multiplying means has a greater mechanical advantage at the start of movement and a lesser mechanical advantage as movement continues.

3. In an impact tool as defined in claim 1, wherein: said moving means is constructed and arranged to move both said bodies toward and into engagement with said ram means substantially simultaneously on opposite sides thereof.

4. In an impact tool for producing an impact against an object:

(a) elongated ram means mounted for movement along a longitudinal path, in opposite directions;

(b) a pair of oppositely rotating bodies for storing energy and mounted on opposite sides of said ram means for movement toward and away from said ram path, each said body having an axis of rotation generally perpendicular to the direction of movement of said ram means;

(c) means for moving said rotating bodies substantially simultaneously toward and into engagement with said ram means on the respective side thereof, whereby said rotating bodies impart linear movement to said ram means;

(d) said moving means including force multiplying means and means for moving said force multiplying means;

(e) said force multiplying means having a greater mechanical advantage at the start of movement and a lesser mechanical advantage as movement continues and including at least one pair of pivoted links in an essentially straight line position when said rotating body is spaced away from said ram means;

(f) means for moving said bodies away from the path of said ram means; and (g) means for returning said ram means to its initial position.

5. In an impact tool for producing an impact against an object:

(a) elongated ram means mounted for movement along a longitudinal path, in opposite directions;

(b) a pair of oppositely rotating bodies for storing energy and mounted on opposite sides of said ram means for movement toward and away from said ram means, each said body having an axis of rotation generally perpendicular to the direction of movement of said ram means;

(c) means for moving said bodies substantially simultaneously toward and into engagement with said ram means, whereby said rotating bodies impart linear movement to said ram means;

(d) said means for moving said bodies toward and into engagement with said ram means includes force multiplying means and electrically actuated means for moving said force multiplying means;

(e) said force multiplying means includes at least one essentially non-stretchable cable connected at an intermediate position to said electrically actuated means but in an essentially straight line position when said rotating body is spaced away from said ram means;

(f) means for moving said bodies away from the path of said ram means; and (g) means for returning said ram means to its initial position.

6. In an impact tool as defined in claim 5, including:

connections from said non-stretchable cable for moving each rotating body into engagement with said ram.

7. In an impact tool for producing an impact against an object:

(a) elongated ram means mounted for movement along a longitudinal path, in opposite directions;

(b) a pair of oppositely rotating bodies for storing energy and mounted on opposite sides of said ram means for movement toward and away from said ram means, each said body having an axis of rotation generally perpendicular to the direction of movement of said ram means;

(c) means for moving said rotating bodies substantially simultaneously toward and into engagement with said ram means on the respective side thereof, whereby said rotating bodies impart linear movement to said ram means;

(c) means for returning said ram means to its initial position including a series of cords connected to said ram means extending essentially in the direction of said longitudinal path and comprising material having the property of rubber in elongating generally equally along the length thereof during an impacting movement of said ram;

(e) a support for said cords disposed in fixed position in the direction of movement of said ram, but spaced from the opposite end of said ram;

(f) said cords extend from said support longitudinally of the direction of movement of said ram to a point on said ram at one side of the central longitudinal axis thereof, thence transversely of said ram to a second point similarly spaced from said axis of said ram but on the opposite side thereof, thence longitudinally to said support; and (g) means for moving said bodies away from said ram means.

8. In an impact tool for producing an impact against an object, comprising:

(a) an elongated ram means mounted for movement along a longitudinal path, in opposite directions;

(b) a first rotating body for storing energy and mounted on one side of said ram means for movement toward and away from said ram means, said body having an axis of rotation generally perpendicular to the direction of movement of said ram means;

(c) a second rotating body rotating in an opposite direction to the rotation of said first body and about an axis parallel to the axis of said first body;

(d) a separate member to which is transmitted forces and components of forces produced by rotation of the corresponding rotating body;

(e) tension means connecting said members for receiving and equalizing forces and components of forces produced by the rotation of said bodies;

(f) means for moving said bodies substantially simultaneously toward and into engagement with said ram means on opposite sides thereof, whereby each said rotating body imparts linear movement to said ram means;

(g) means for moving said bodies away from the path of said ram means; and (h) means for returning said ram means to its initial position.

9. In an impact tool as defined in claim 8, wherein:

said rotating bodies are pivoted on parallel pivot shafts; and said tension means comprises a tension rod extending between said pivot shafts to equalize forces and components of forces in the direction of said tension rod.

10. In an impact tool as defined in claim 9, wherein:

each rotating body comprises a flywheel mounted on a shaft coaxially with a motor for driving said flywheel; and said tension rod is disposed in the space around said shaft between each flywheel and its corresponding motor.

11. In an impact tool as defined in claim 9, wherein: the angle for each rotating body between a plane extending through said pivot shaft and the axis of rotation of said rotating body prior to movement toward said ram and a plane extending through said pivot shafts and said tension rod, is on the order of 9° to 20°.

12. In an impact tool for producing an impact against an object:

(a) elongated ram means provided with a lateral wing at each side and mounted for movement along a longitudinal path in opposite directions, each said wing having a longitudinal slot;

(b) a pair of oppositely rotating bodies for storing energy and mounted on opposite sides of said ram means for movement toward and away from said ram means, each said body having an axis of rotation generally perpendicular to the direction of movement of said ram means;

(c) means for moving said rotating bodies substantially simultaneously toward and into engagement with said ram means on the respective side thereof, whereby said rotating bodies impart linear movement to said ram means;

(d) guide rods for said ram disposed longitudinally and extending through the corresponding slot in each wing;

(e) means for moving said bodies away from the path of said ram means; and (f) means for returning said ram means to its initial position.

13. In an impact tool as defined in claim 12, including: shock absorbing bumpers spaced laterally to permit a portion of said ram, between said wings and extending in the direction of movement of said ram, to move between said bumpers on an impact movement; and said bumpers being positioned for engagement by the respective wing of said ram upon movement of said ram beyond a predetermined distance.

14. In an impact tool as defined in claim 12, including: means for retaining said guide rods laterally with respect to the ram path; and removable means for retaining said guide rods longitudinally but permitting longitudinal removal of said rods from said lateral retaining means.

15. In an impact tool for producing an impact against an object:

(a) elongated ram means mounted for movement along a longitudinal path, in opposite directions;

(b) a pair of oppositely rotating bodies for storing energy mounted on opposite sides of said ram means for movement toward and away from said ram, each body having an axis of rotation generally perpendicular to the direction of movement of said ram means;

(c) means for moving said rotating bodies substantially simultaneously toward and into engagement with said ram means on the respective side thereof, whereby said rotating bodies impart linear movement to said ram means;

(d) force multiplying means connected by cable to electrical solenoid means for moving said bodies toward and into engagement with said ram means;

(e) means for moving said bodies away from the path of said ram means; and (f) means for returning said ram means to its initial position.

16. In an impact tool as defined in claim 15, wherein: said solenoid cable connects a plunger of said solenoid means to a pivot center of said force multiplying means.

17. In an impact tool as defined in claim 16, wherein: said force multiplying means comprises a pair of links pivoted together and positioned in a substantially straight line relation for the beginning of movement;

a movable bar is pivotally connected to a movable end of one said link;

a cable connects said bar to said rotating body; and a pivoted arcuate guide engages said solenoid cable.

18. In an impact tool as defined in claim 17, wherein: said force multiplying means includes two pair of pivoted links mounted in essentially parallel, spaced relation, with a cable from a separate solenoid connected to the pivot connection between each pair of links; and the movable end of one link of each pair is pivotally connected to said movable bar.

19. In an impact tool as defined in claim 16, wherein said force multiplying means includes:

a first cable having a fixed end and a movable end having cable connections for moving said rotating bodies simultaneously;

a second cable having one end fixed and the opposite end connected to the movable end of said first cable, said second cable being essentially transverse to said first cable;

said solenoid cable connected to said plunger of said solenoid means and to an intermediate point on said first cable between said fixed end and said movable end; and said first cable being in an essentially straight line position prior to movement of said rotating bodies and said solenoid cable exerting a pull at said intermediate point substantially transverse to said straight line.

20. An impact tool for producing an impact against an object comprising:

(a) elongated ram means mounted for movement along a longitudinal path, in opposite directions;

(b) oppositely rotating bodies for storing energy and mounted on opposite sides of said ram means, said bodies having parallel axes of rotation, which axes are generally perpendicular to the direction of movement of said ram means;

(c) means for causing said bodies to engage said ram means on opposite sides thereof substantially simultaneously, whereby said rotating bodies impart linear movement to said ram means;

(d) means for moving said bodies from the path of said ram means;

(e) means for returning said ram means to its initial position;

(f) coaxial motors having housings of a diameter corresponding to said rotating bodies for rotating said bodies;

(g) means including a pivoted lever for deterring said linear movement of said ram, said lever being disposed below the space between said motor housings and having an upwardly extending arm provided with a block whose normal position is between said motor housings, to prevent said motors and bodies from being moved to a position of engagement by said bodies with said ram;

(h) resilient means for urging said lever in a direction to move said block between said motor housings;

(i) a movable element engageable with a work piece associated with the operation of said ram; and (j) means associated with said movable element including a rod engageable with said lever for pivoting said lever to move said block from between said motor housings a distance sufficient to permit said rotating bodies to be moved into engagement with said ram.

21. An impact tool for producing an impact against an object, comprising:

(a) elongated ram means mounted for movement along a longitudinal path, in opposite directions;

(b) oppositely rotating bodies for storing energy and mounted on opposite sides of said ram means for movement toward and away from said ram means, said bodies having parallel axes of rotation, which axes are generally perpendicular to the direction of movement of said ram means;

(c) means for moving said bodies toward and into engagement with said ram means substantially simultaneously on opposite sides thereof, whereby said rotating bodies impart linear movement to said ram means;

(d) each side of said ram means being provided with a taper extending outwardly opposite the direction of said linear movement of said ram means at a position of initial engagement of said ram means by said rotating bodies, whereby movement of said ram means initiated by said rotating bodies forces said rotating bodies apart and thereby increases the force normal to the sides of said ram means while said rotating bodies engage said taper;

(e) means for moving said bodies away from the path of said ram means; and (f) means for returning said ram means to its initial position.

22. An impact tool as defined in claim 21, wherein:

said taper of said ram means is on the order of 0.010 inch to 0.025 inch in 0.500 inch of length of said ram.

23. An impact tool as defined in claim 21, wherein:

said ram means is provided on each side with friction surface means.

24. An impact tool as defined in claim 23, wherein:

said friction surface means is substantially uniform in thickness; and said ram means includes a body having sides provided with said taper.

25. An impact tool as defined in claim 23, wherein:

said ram means includes a body having parallel sides; and said friction surface means is provided with said taper.

26. An impact tool as defined in claim 21, wherein:

said ram means includes a body provided with said taper; and said rotating bodies are provided with friction surface means for engagement with said respective sides of said ram.

27. An impact tool as defined in claim 21, wherein:

said ram means is provided at the end opposite the end of initial engagement with a taper on each side extending inwardly in a direction opposite said linear movement of said ram means.

* * * * *